US006791273B2

(12) United States Patent
Ito et al.

(10) Patent No.: US 6,791,273 B2
(45) Date of Patent: Sep. 14, 2004

(54) VEHICLE LIGHTING FIXTURE

(75) Inventors: Masayasu Ito, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/397,892

(22) Filed: Mar. 26, 2003

(65) Prior Publication Data

US 2004/0004451 A1 Jan. 8, 2004

(30) Foreign Application Priority Data

Mar. 27, 2002 (JP) ..... P. 2002-088231

(51) Int. Cl.[7] ..... H05B 37/02
(52) U.S. Cl. ..... 315/82; 315/224; 307/10.8
(58) Field of Search ..... 315/82, 224, DIG. 7, 315/83; 307/10.8

(56) References Cited

U.S. PATENT DOCUMENTS 5,198,727 A * 3/1993 Allen et al. ..... 315/291
5,646,485 A * 7/1997 Simon et al. ..... 315/82

FOREIGN PATENT DOCUMENTS

JP 2001-080411 3/2001
JP 2001-146131 5/2001

* cited by examiner

*Primary Examiner*—David Vu
(74) *Attorney, Agent, or Firm*—Fish & Richardson P.C.

(57) ABSTRACT

A vehicle lighting device uses a high-beam discharge lamp and a low-beam discharge lamp, and includes a DC/DC converter circuit, DC/AC converter circuit, starter circuits, and a control circuit for controlling the lighting of the discharge lamps by detecting voltage or current of each said arch discharge. When the high-beam discharge lamp is lit on in a state that the low-beam discharge lamp is lit off, the low-beam discharge lamp is lit on with some time delay to thereby reduce the number of lighting times and the lighting time. When one of the discharge lamps is lighting, the other of the discharge lamps is lit off, thereby reducing the number of lighting times and the lighting time of the other discharge lamp.

7 Claims, 8 Drawing Sheets

VEHICLE LIGHTING FIXTURE

BACKGROUND OF THE INVENTION

1. Field of the Invention

The present invention relates to techniques for preventing reduction of the service life of a discharge lamp in a vehicle lighting device using the same lamp.

2. Description of the Related Art

A discharge lamp, such as a metal halide lamp, is used for a small light source for a vehicle. A lighting circuit is used for lighting on such a light source. A known lighting circuit includes a DC/DC converter circuit, a DC/AC converter circuit and a starter circuit.

Where discharge lamps are used for a light source for the running beam (called the high beam) and a light source for the dipped beam (called the low beam), two types of lighting circuits are known for lighting the discharge lamps. A first lighting circuit contains lighting circuits respectively for lighting the discharge lamps. A second lighting circuit contains common circuits used in common for the two discharge lamps. The common circuits are, for example, the DC/DC converter circuit and the DC/AC converter circuit. The latter lighting circuit is advantageous in cost and installing space.

In either lighting circuit, where it is designed such that the driver may give an instruction to substantially simultaneously light on both the high-beam and low-beam discharge lamps, the driver tuns on a lamp lighting switch in a state that the operation lever is set to the low beam side, or turns on or off for a short time by operating the lever, switch or the like.

In the conventional vehicle lighting device, when the high-beam discharge lamp and the low-beam discharge lamp are substantially simultaneously lit on, inconvenience is present which is caused by indefinite rules on which of the high-beam discharge lamp and the low-beam discharge lamp is first turned on.

For example, in a vehicle lighting device using the high-beam discharge lamp and the low-beam discharge lamp, which designed to allow an operation to light on both the discharge lamps, and an operation to light on only the low-beam discharge lamp, difference will occur between those discharge lamps in the use time and the number of times of lighting the discharge lamps. Where the discharge lamps are used for producing the high-beam and the low-beam, it is a rare case that the high-beam discharge lamp and the low-beam discharge lamp are used at the equal number of times. Generally, the driver more frequently uses the low-beam discharge lamp. The same thing is true for the whole lamp lighting time and the number of lamp lighting operations. Therefore, the service life of the low-beam discharge lamp, rather than the high-beam discharge lamp, must be taken into consideration. In other words, the service life of the high-beam discharge lamp is sufficiently long in the light of the use frequency of the discharge lamp.

The lighting time and the number of lighting operations may be enumerated for the factors to determine the reduction of the service life of the discharge lamp if the discharge lamps are under the same power inputting conditions. Electric power higher than the rated power is input to the discharge lamp in order to improve a light flux rising characteristic when a discharge lamp lighting device is started. Accordingly, as the number of lighting times is larger, the necessity of replacing the discharge lamp with a new one, which result from life deterioration, occurs before the usual replacing time.

When the serving time and the use frequency of the low-beam discharge lamp becomes considerably large when comparing with the high-beam discharge lamp, the life deterioration of the discharge lamp is remarkable. In particular, where the flashing operation, such as passing, is repeated many times, the service life of the discharge lamp is reduced.

To cope with this, the following measure may be taken. When the high-beam discharge lamp is lit on in a state that the low-beam discharge lamp is lighting, there is no need of turning on the two discharge lamps. According to the rule, only the high-beam discharge lamp is light on, while the low-beam discharge lamp is lit off. In this case, when the high-beam discharge lamp is lit off, the low-beam discharge lamp must be lit on. As a result, the number of lighting times increases, and the life deterioration progresses.

SUMMARY OF THE INVENTION

Accordingly, an object of the present invention is to take a measure for increasing the service life of the discharge lamps in a vehicle lighting device having a lighting circuit in which discharge lamps are used for the high- and low-beam irradiation.

According to an aspect of the invention, there is provided a vehicle lighting device which uses a high-beam discharge lamp and a low-beam discharge lamp, and includes a DC/DC converter circuit for converting an input voltage output from a DC power source into a desired DC voltage, a DC/AC converter circuit for converting an output voltage of the DC/DC converter circuit into an AC voltage, starter circuits for applying start pulse signals to the discharge lamps, and a control circuit for controlling the lighting of the discharge lamps by detecting voltage or current of each arch discharge, wherein when an instruction to light on the high-beam discharge lamp and the low-beam discharge lamp is given, and the high-beam discharge lamp is lit on in a state that the low-beam discharge lamp is lit off, the low-beam discharge lamp is lit on with some time delay.

According to another aspect, the vehicle lighting device thus constructed is characteristically featured in that when one of the high-beam discharge lamp and the low-beam discharge lamp is lighting, the other discharge lamp is lit off.

The invention reduces the lighting time and the number of lighting times thereby preventing the reduction of the service life of the discharge lamps, and the replacement frequency.

DETAILED DESCRIPTION OF THE PREFERRED EMBODIMENTS

Figure 1:
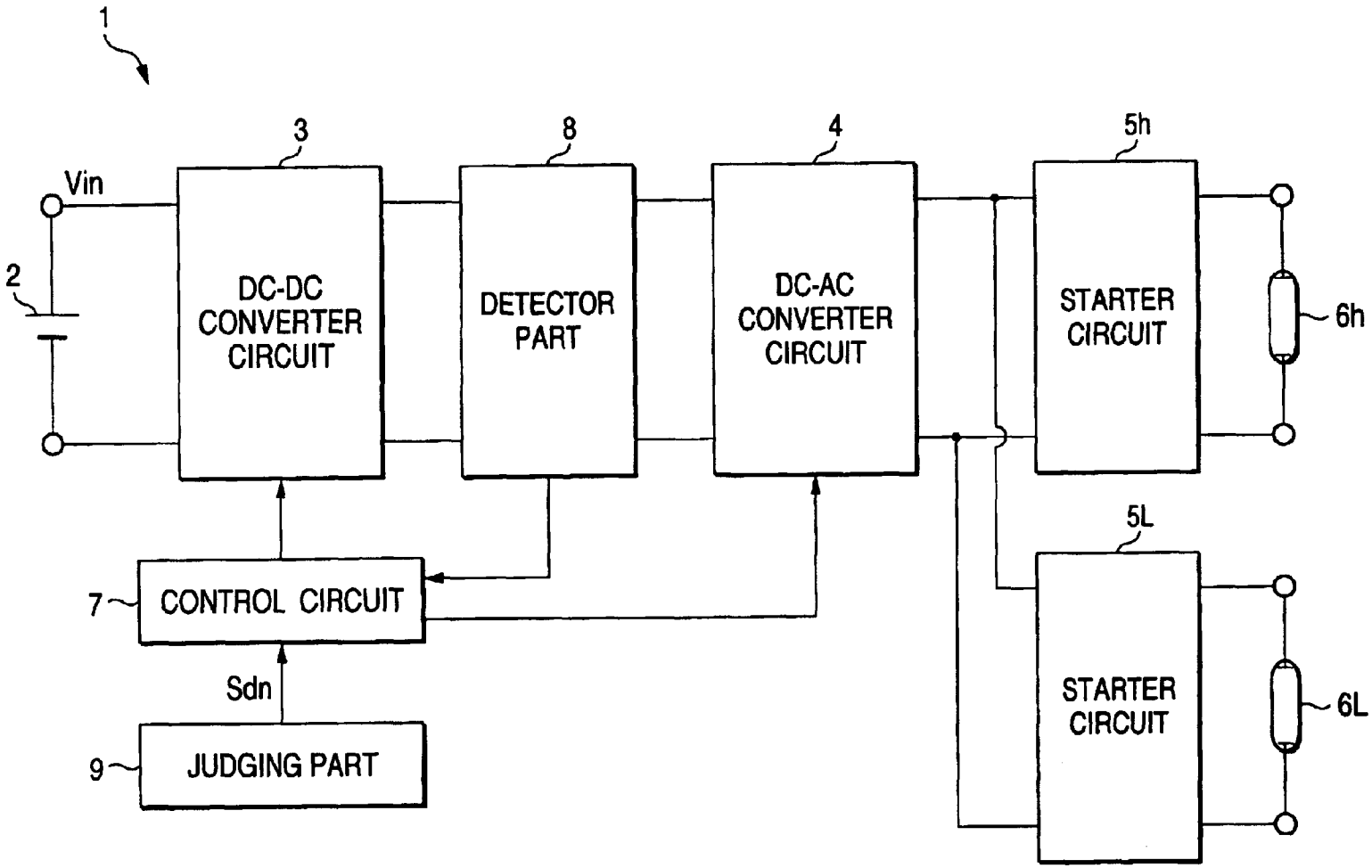
FIG. 1 is a block diagram showing a basic arrangement of a vehicle lighting device constructed according to the invention.

FIG. 1 is a block diagram showing a basic arrangement of a lighting circuit 1 which partly constitutes a vehicle lighting device constructed according to the invention. As shown, the lighting circuit includes a DC power source 2, a DC-to-DC (DC/DC) converter circuit 3, a DC-to-AC (DC/AC) converter circuit 4, a starter circuit (called starters) 5*h* and 5L, and a control circuit 7.

A technique which controls the lighting of a plurality of discharge lamps by use of a common lighting circuit is known. A part of the lighting circuit is commonly used for the lighting of both a discharge lamp 6*h* for high-beam irradiation (referred to as a high-beam discharge lamp) and a discharge lamp 6L for low-beam irradiation (referred to as a low-beam discharge lamp). Specifically, in the embodiment, the DC/DC converter circuit 3, DC/AC converter circuit 4, and a control circuit 7 and the like are commonly used for both the discharge lamps. The lighting operation, controls, circuit protection and the like are integrally incorporated into its configuration. In other words, where two discharge lamps are used, the lighting circuits may be provided for those discharge lamps, respectively. Such configuration is disadvantageous in the number of parts and cost to manufacture, however. To avoid this, the circuit is preferably designed such that a circuit or parts of the lighting circuits that may be commonly used for both the discharge lamps are replaced by a single circuit for lighting both the discharge lamps. It should be understood that the circuit arrangement where the lighting circuits are used for the discharge lamps, respectively, is involved in the invention.

The DC/DC converter circuit 3 receives a DC input voltage (denoted as "Vin") from the DC power source 2, and converts it into a desired DC voltage. For example, a flyback DC/DC converter may be used for the DC/DC converter circuit.

The DC/AC converter circuit 4 converts the output voltage of the DC/DC converter circuit 3 into an AC voltage, and then supplies it to the discharge lamps, through the starter circuits. In a full bridge circuit, for example, two arms are formed by using four semiconductor switching elements. Further, a drive circuit is provided for driving the switching elements of the arms. The drive circuit oppositely turns on and off two sets of switching elements in accordance with a signal derived from the control circuit 7.

The starter circuit 5*h* is provided for the high-beam discharge lamp 6*h*, and the starter circuit 5L, for the low-beam discharge lamp 6L. Each of the starter circuits generates a high voltage pulse signal (start pulse) for starting the corresponding discharge lamp, and starts the discharge lamp. Specifically, the start pulse signal is superposed on an AC voltage output from the DC/AC converter circuit 4, and the resultant is applied to each of the discharge lamp 6*h* and 6L.

The control circuit 7 receives voltage applied to or current flowing through each discharge lamp or a signal corresponding to the voltage or current, and controls electric power to be input to the discharge lamp, and further controls the output of the DC/DC converter circuit 3. In other words, the control circuit 7 is provided for controlling the supplying electric power in accordance with a state of the discharge lamp. For example, the control circuit receives a detector 8 which detects an output voltage or current of the DC/DC converter circuit 3, and responsively sends a control signal to the DC/DC converter circuit 3 to control its output voltage. And it sends a control signal to the DC/AC converter circuit 4 to control the same. Before the lamp is turned on, the control circuit increases a level of the voltage to be applied to the discharge lamp to a certain level of voltage, thereby ensuring reliable lighting of the discharge lamp. Some known switching control systems are a PWM (pulse width modulation) system and a PFW (pulse frequency modulation) system.

A judging part 9 is coupled to the control circuit 7. The judging part judges whether it is daytime or nighttime on the basis of various information to be given later, and sends the judgement result to the control circuit 7. In the figure, a signal denoted as "Sdn" indicates a judgment result of daytime or nighttime.

Figure 2:
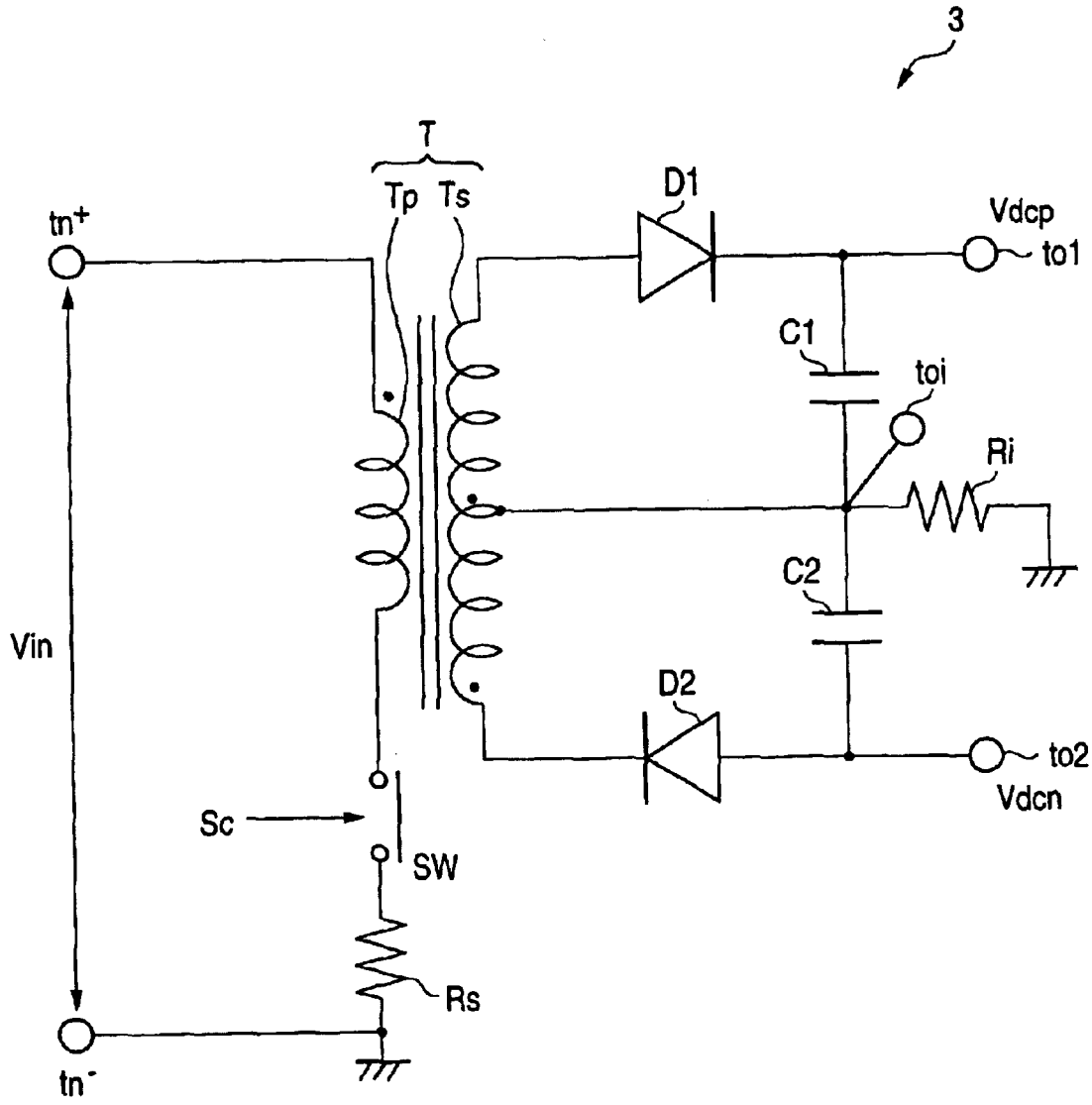
FIG. 2 is a circuit diagram showing an arrangement of a DC/DC converter circuit.

FIG. 2 shows an exemplar circuit arrangement of the DC/DC converter circuit 3. The voltage Vin is input to input terminals "tn+" and "tn−" of the DC/DC converter circuit.

The primary winding Tp of a transformer T is connected, at one end (winding start end) to a DC input terminal "tn+". The other end (winding end terminal) of the primary winding Tp is earthed through a semiconductor switching element SW (indicated simply by a switch symbol, actually it is a field effect transistor or the like) and a current detecting resistor Rs (it is optionally used, and it may be omitted, if necessary). A signal "Sc" is applied from the control circuit 7 to the control terminal (gate when the switching element is an FET) of the semiconductor switching element SW to thereby control the switching operation of the semiconductor switching element.

The secondary winding Ts of the transformer T is connected, at one end (winding end terminal), to the anode of a diode D1. The cathode of the diode D1 is connected to one end of a capacitor C1, and also to a terminal "to1". An output voltage (denoted as "Vdcp") is output from the terminal. The other end of the capacitor C1 is connected to an intermediate tap of the secondary winding Ts, and earthed through a resistor Ri.

The other end (winding start terminal) of the secondary winding Ts is connected to the cathode of a diode D2. The anode of the diode D2 is connected to a capacitor C2 and a terminal "to2, and an output voltage (denoted as "Vdcn") is output through the terminal.

The resistor Ri is a current detecting element for producing a detect signal on a current flowing through the discharge lamp. It converts current flowing therethrough into voltage to thereby effect the current detection. A detecting terminal "toi" is connected to a node at which the resistor Ri and the capacitors C1 and capacitor C2 are interconnected. A detection signal is derived from the detecting terminal.

As described above, in this embodiment, the positive polarity voltage Vdcp and the negative polarity voltage Vdcn are output from the terminals "to1" and "to2", respectively.

A dot mark "•" affixed to the transformer T indicates a start end of the winding. In the case of the secondary winding Ts, for example, the dot mark "•" is affixed to its connection terminal connecting to the diode D2 and a winding start end of the intermediate tap.

Figure 3:
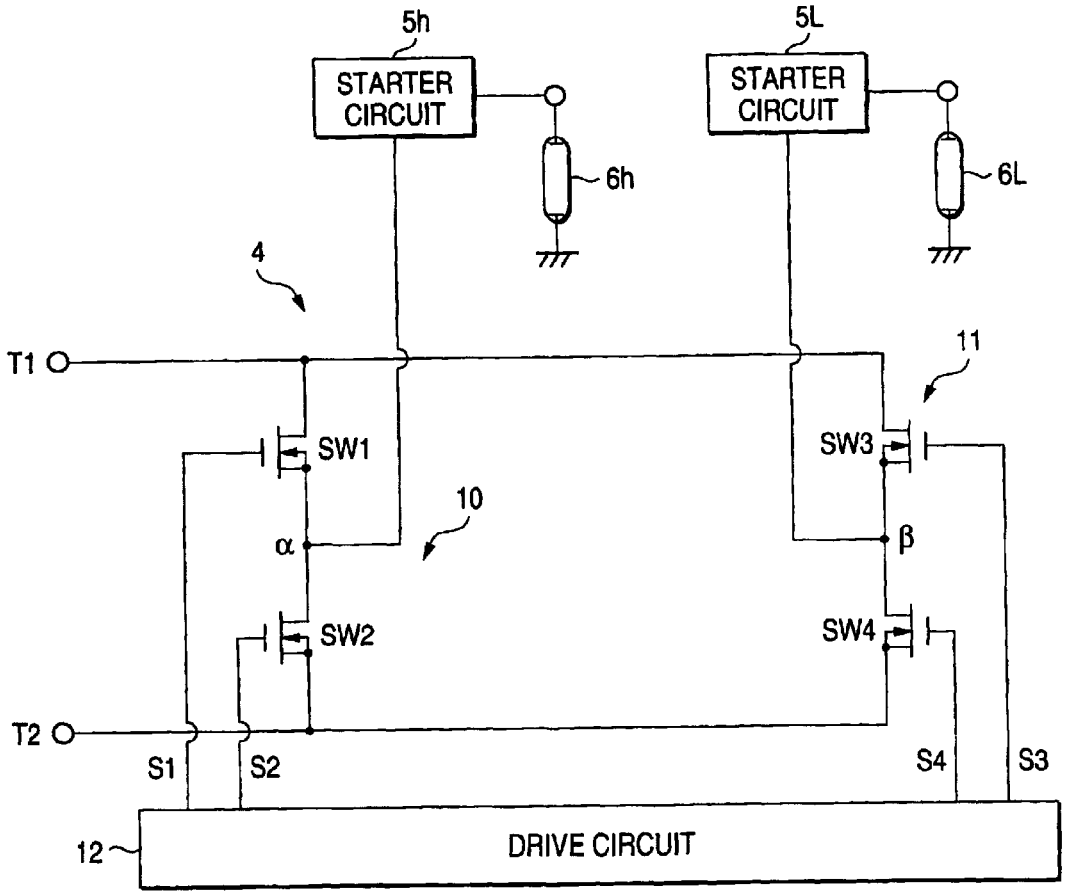
FIG. 3 is a circuit diagram showing an arrangement of a DC/AC converter circuit.

FIG. 3 shows a circuit arrangement of the DC/AC converter circuit 4. In this instance, the DC/AC converter circuit is of the full bridge type in which four semiconductor switching elements SW1 to SW4 are arranged in a bridge fashion.

Each switching element consists of an N-channel MOSFET. An arm (left arm in the figure) 10 including the switching elements SW1 and SW2 and another arm (right arm in the figure) 11 including the switching elements SW3 and SW4 are connected in parallel.

In the left arm 10, the switching elements SW1 and SW2 are connected in series, and a drain of the FET forming the switching element SW1 is connected to an input terminal T1. A source of the FET forming the switching element SW2 is connected to another input terminal T2. A junction "α" indicates a node between the switching elements SW1 and SW2.

In the right arm 11, the switching elements SW3 and SW4 are connected in series, and a drain of the FET forming the switching element SW3 is connected to another input terminal T2. A source of the FET forming the switching element SW4 is connected to another input terminal T2. A junction "β" indicates a node between the switching elements SW3 and SW4.

Signals derived from the nodes α and β are applied to the discharge lamps, respectively. Specifically, the node α is connected to the starter circuit 5*h* (inductive element thereof) and then to the high-beam discharge lamp 6*h*. The node β is connected to the starter circuit 5L (inductive element thereof) and then to the low-beam discharge lamp 6L (one end of each discharge lamp is grounded directly or through a current detecting resistor).

A drive circuit 12 sends control signals S1 to S4 to the switching elements SW1 to SW4 to thereby define the polarities of the bridge circuit. Specifically, the drive circuit sends the control signals SW1 to SW4 to the gates of the FETs, which form the switching elements SW1 to SW4, and drive those switching elements and sets on/off states of those elements. It is assumed that at a certain time point, the switching element SW1 is put in an on state, and the switching element SW2 is put in an off state. At this time, the semiconductor switching element SW3 is put to the off state, and the switching element SW4 is to the on state. It is assumed that at another time point, the switching element SW1 is put in the off state, and the switching element SW2 is put in the on state. At this time, the semiconductor switching element SW3 is put to the on state, and the switching element SW4 is to the off state. Thus, the switching elements SW1 and SW4 are in the same condition, whereas the switching elements SW2 and SW3 are in the same condition, whereby these switching elements operate alternately.

Operating means, such as lighting switches, are omitted in FIG. 1. Those operating means may be provided in the following ways.

(A) A lighting switch for lighting the high-beam discharge lamp and a lighting switch for the low-beam discharge lamp are separately provided.

(B) A lighting switch for lighting the high-beam discharge lamp and a lighting switch for simultaneously lighting the high-beam discharge lamp and the low-beam discharge lamp are separately provided.

(C) A switch used exclusively for the passing operation is additionally provided in the switch arrangement (A) above.

In the switch arrangement (A), the lighting switches are provided for the related discharge lamps, respectively. The conventional car body wiring may be used as it is. In this arrangement, the lamp lighting switch may be turned on in a state that the operation lever is turned to the high beam side. Further, when the operation lever is pulled to this side to the passing operation, both the discharge lamps may be turned on.

The switch arrangement (B) above includes the simultaneously lighting switch, and is advantageous in reducing the capacities of the high-beam lighting switch and its wiring.

In the switch arrangement (C) above, a switch which is turned on when the light operation lever is pulled to this side is provided for the dedicated switch. Through that operation, the passing operation may be effected. Accordingly, the circuit side readily recognizes if the driver currently performs the operation. In other words, when the driver operates for the passing operation and issues a lighting instruction, the dedicated switch is in an on state, and an instruction to simultaneously turning on both the discharge lamps is sent to the lighting circuit.

Those switch arrangements are all available for the invention. The instant embodiment will be described on the assumption that the switch arrangement (B) is employed.

In the invention, controls for lighting the respective discharge lamps are carried out according to the following rule (1) or (2).

(1) An instruction for lighting both the high-beam discharge lamp and the low-beam discharge lamp is issued. When the high-beam discharge lamp is lit on in a state that the low-beam discharge lamp is not lit, the low-beam discharge lamp is lit on with some delay.

(2) When one of the discharge lamps is lighting, the other lamp is lit off.

The rule (1) above is set up allowing for the service life of the low-beam discharge lamp of which the use time is long and the use frequency is high. The rule (2) is set up for the purpose that in a state that the high-beam discharge lamp is already lit on, the low-beam discharge lamp is prohibited from being lit on, to thereby reduce the lighting time and the number of lighting times of the low-beam discharge lamp.

Figure 4:
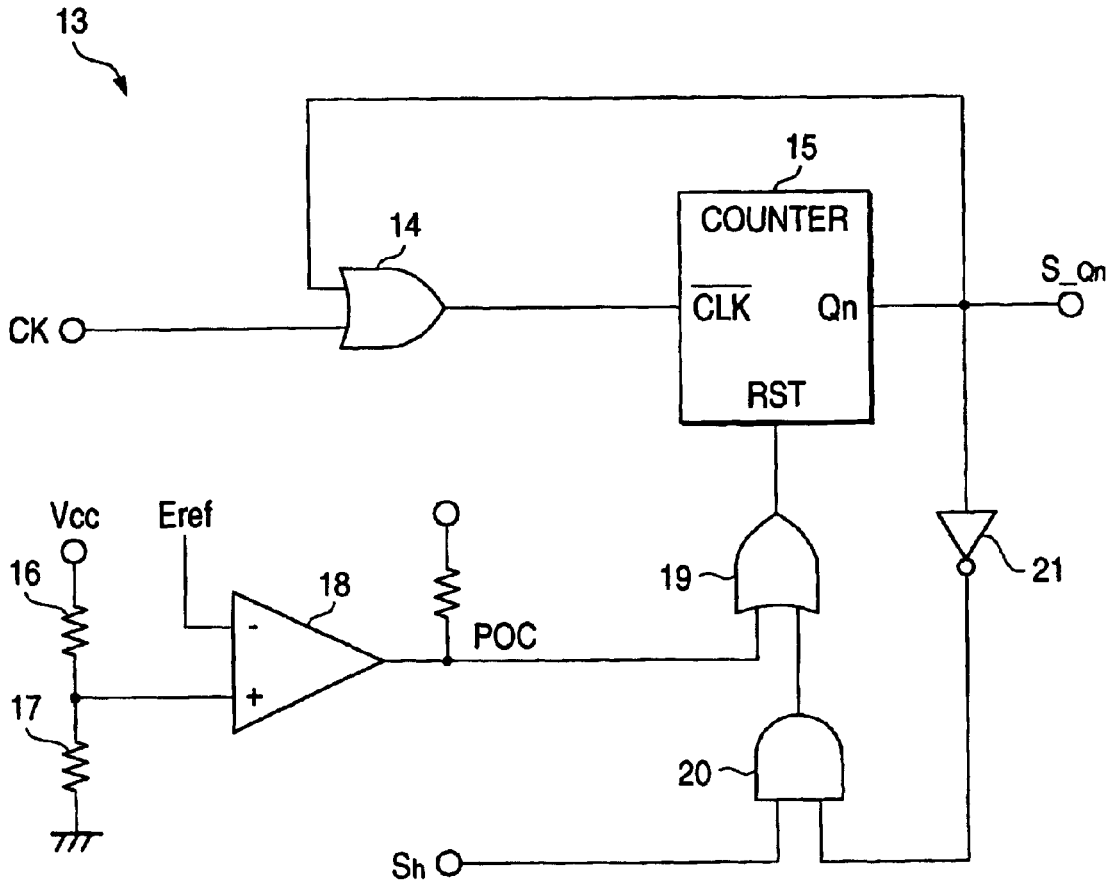
FIG. 4 is a circuit diagram showing an exemplar circuit arrangement constructed according to the invention.
Figure 8:
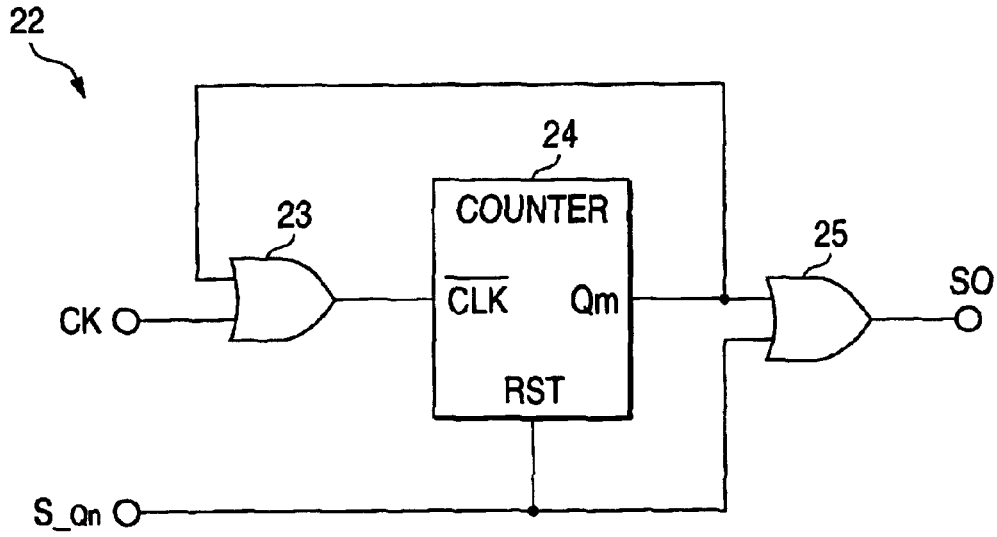
FIG. 8 is a circuit diagram showing a circuit arrangement for lighting a low-beam discharge lamp with some time delay.

The rule (1) will be described by using specific circuit examples (FIGS. 4 and 8).

FIG. 4 shows an exemplar circuit 13 of a key portion of the circuit arrangement. In the circuit, the lighting-on or the lighting-off of the discharge lamp is determined by whether the DC/DC converter circuit 3 or the DC/AC converter circuit 4 is operated or not. When the DC/DC converter circuit 3 or the DC/AC converter circuit 4 receives a signal sent from the control circuit 7 to partially or entirely stop its operation, the discharge lamp lights off. Such a signal as to determine the circuit operation will be referred to as a "light-on instruction signal". When the lighting-on instruction signal is in a logical high (H) level, the discharge lamp is lit up. When it is in a logical low (L) level, the discharge lamp is lit off.

In the figure, a signal denoted by "CK" is a clock signal generated by a signal generator (not shown). The clock signal CK is applied to a clock signal input terminal (indicated by "CLK" with a bar put on the top in the figure) of a counter 15 by way of a two-input OR (logical sum) gate 14.

A signal derived from the output terminal "Qn" at a predetermined stage in the counter 15 is sent to the OR gate 14, and it and the clock signal CK are logically summed, and the result of the logical summing is applied to the clock signal input terminal of the counter 15.

"Vcc" indicates a circuit power source voltage. A voltage detected by dividing resistors 16 and 17 is applied to a positive input terminal of a comparator 18. The comparator compares it with a reference voltage "Eref" received at a negative input terminal thereof. An output signal (denoted as "POC (pulse on clear)" of the comparator 18 is input to one of the input terminals of a two-input OR gate 19. In this instance, the circuit arrangement is presented in which the POC signal is generated by use of the comparator. Various other circuit arrangements may be used for generating the same, as a matter of course. An example of such is a circuit arrangement which uses, for example, an initializing signal of the circuit power source.

A signal "Sh" is an input signal produced when the lighting switch for the high beam irradiation is operated. When the signal "Sh" is in an H level, an operation instruction for the high beam irradiation is given.

The signal "Sh" is applied to one of the input terminals of a two-input AND (logical product) gate 20. An output signal derived from a terminal "Qn" of the counter 15 is input to the other input terminal of the AND gate by way of a NOT (logical NOT) gate 21.

An output signal of the AND gate 20 and a POC signal from the comparator 18 are sent to the two-input OR gate 19. And an output signal of the gate is supplied to a reset terminal "RST" of the counter 15.

Figure 5:
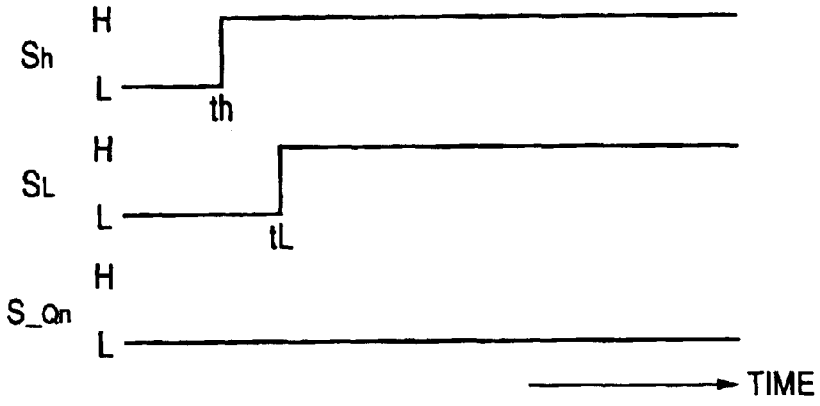
FIG. 5 is a timing chart showing operations of the FIG. 4 circuit, in cooperation with FIGS. 6 and 7; in the operation chart, an instruction for high beam irradiation and an instruction of low beam irradiation are substantially simultaneously issued, exactly the high beam irradiation instruction is issued slightly earlier than the low beam irradiation instruction.
Figure 6:
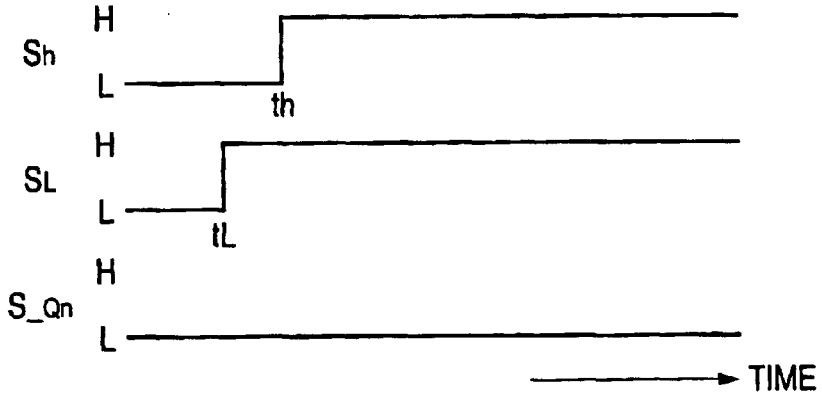
FIG. 6 is an operation chart in which the instruction for high beam irradiation and the instruction of low beam irradiation are substantially simultaneously issued, exactly the high beam irradiation instruction is issued slightly later than the low beam irradiation instruction.
Figure 7:
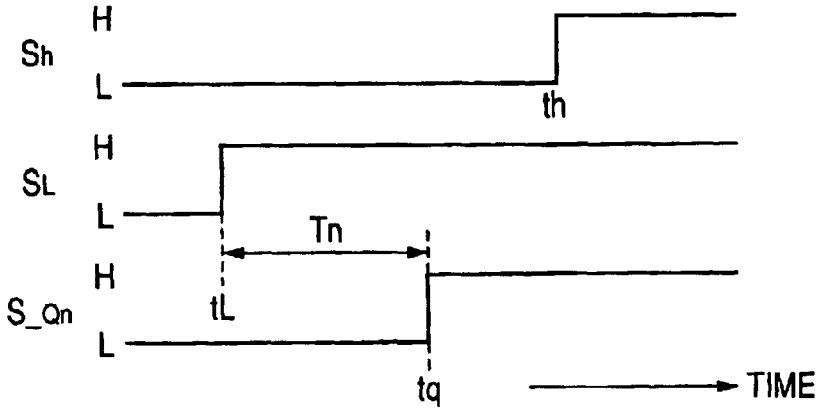
FIG. 7 is an operation chart in which the high beam irradiation instruction is issued much later than the low beam irradiation instruction.

FIGS. 5 through 7 are timing charts for explaining exemplar operations of the circuit mentioned above. Symbols used in those figures are as defined below.

"SL": input signal produced when the lighting switches for low beam and high beam are operated (in the case of H level, an operation instruction is given).

"S_Qn": output signal derived from the output terminal "Qn" of the counter 15.

The signal "Sh" is as already described. Time points "th", "tL" and "tq" are as follows:

"th": time point at which the signal "Sh" rises

"tL": time point at which the signal "SL" rises

"tq": time point at which the output signal "S_Qn" rises

A time period "Tn" shown in FIG. 7 is a delay time (ranging from tL to tq).

When the signal SL appears in the circuit, and after a while, the signal "Sh" appears, the discharge lamps are lit on response to those signals input. When both the signals are input to the exemplar circuit at the same time, some judgement is required on the signal inputting. Actually, it never happens that both the signals Sh and Sl are input to the circuit at exactly the same time point, and those signals reach the circuit with a slight time difference. The operations of relays, switches and others are inevitably attendant with dimensional errors, and chattering phenomenon. Therefore, it is an extremely rare case that both the signals reach the circuit at exactly the same time point. For this reason, in design, it is essential to allow for a time delay of at least several tens milliseconds. In the chart of FIG. 5, the signal "Sh" is first input to the circuit, and at some later time the signal SL is input. In the chart of FIG. 6, the signal SL is first input, and the signal "Sh" is input at a slight later time.

When the lighting switches for the low beam and the high beams are each used for a power source switch of the lighting circuit, the whole circuit starts to operate at a time point at which the power switch is turned on. Accordingly, when the signal "Sh" is first input to the circuit with a slight time difference, as shown in FIG. 5, it may be judged that an instruction to simultaneously lighting on the discharge lamps has been issued. Accordingly, a delay time may be set with a time point at which the signal SL is first input as a reference.

In FIG. 4, it is judged that when the circuit power source is turned on and the POC signal is put in the L level, the circuit is normally operated by the power source voltage Vcc. Exactly, when the power source voltage Vcc rises and the output signal of the comparator 18 is put in the L level, it is detected that the power source voltage Vcc reaches a voltage value required for the normal operation of the circuit. The comparator output signal is applied to the reset terminal of the counter 15 through the OR gate 19.

In the cases of FIGS. 5 and 6, a difference between the inputting times of the signals Sh and signal SL is slight. Accordingly, the AND gate 20 is enabled and an output signal of the AND gate is applied through the OR gate 19 to the counter 15, and the counter 15 is reset. Accordingly, the output signal "S_Qn" remains low level. More exactly, in FIG. 5, the counter 15 is reset at a time point "th" at which the signal Sh is first input. In FIG. 6, a time ranging from the inputting time point "tL" of the signal SL to the inputting time point "tb" is shorter than the set time (determined by the number of stages of the circuits on the frequency of the clock signal CK and the output terminal "Qn") of the counter 15. Accordingly, the counter 15 is reset at the Sh input time point "th".

In the case of FIG. 7, a time ranging from the SL input time point "tL" to the Sh input time point "th" is longer than the set time (corresponding to a time length of a delay time period "Tn" in the figure) of the counter 15, so that the output signal "S_Qn" goes high (H) in logical level at a time point "tq". Specifically, during a time period that the signal Sh is in the L level, the counter 15 starts to count the clock signal CK from a time point where the POC signal is put to the L level. At a time point "tq" at which the delay time period "Tn" is terminated, the counter 15 outputs an H level signal at the output terminal "Qn". Accordingly, even if the signal "Sh" is input to the circuit after that time point, the counter 15 is not reset.

The low-beam discharge lamp 6L is lit on and off by a light-on instruction signal based on the output signal "S_Qn" of the counter 15. A circuit arrangement 22 for generating the light-on instruction signal based on the output signal "S_Qn" is shown in FIG. 8.

The circuit arrangement includes two OR gates and a counter. A clock signal CK is input to one of the input terminals of a two-input OR gate 23, and an output signal derived from a terminal Qm of a counter 24 is input to the other input terminal.

An output signal of the two-input OR gate 23 is supplied to a clock signal input terminal (indicated by "CLK" with a bar symbol put on the top thereof in the figure) of the counter 24.

The output signal "S_Qn" is sent to a reset terminal (RST) of the counter 24 and one of the input terminals of a two-input OR gate 25. The two-input OR gate 25 logically sums the output signal "S_Qn" and the output signal at the terminal Qm of the counter 24, and outputs the logical sum as a light-on instruction signal (denoted as "SO").

In the circuit arrangement, when the output signal "S_Qn" is in the H level, the counter 24 is reset and the output signal "S_Qn" passes through the two-input OR gate 25 and becomes the light-on instruction signal "SO". Accordingly, the low-beam discharge lamp 6L is quickly lit on. The high-beam discharge lamp 6*h* is lit on by using the signal "Sh" as the light-on instruction signal. Accordingly, when the H level signal is input as the signal "Sh", both the discharge lamps are substantially simultaneously lit on. When the signal "Sh" is in the L level, the high-beam discharge lamp 6*h* is in a light-off state. To turn on only the low-beam discharge lamp 6L, what an operator has to do is to merely operate the switch on the signal SL.

Figure 9:
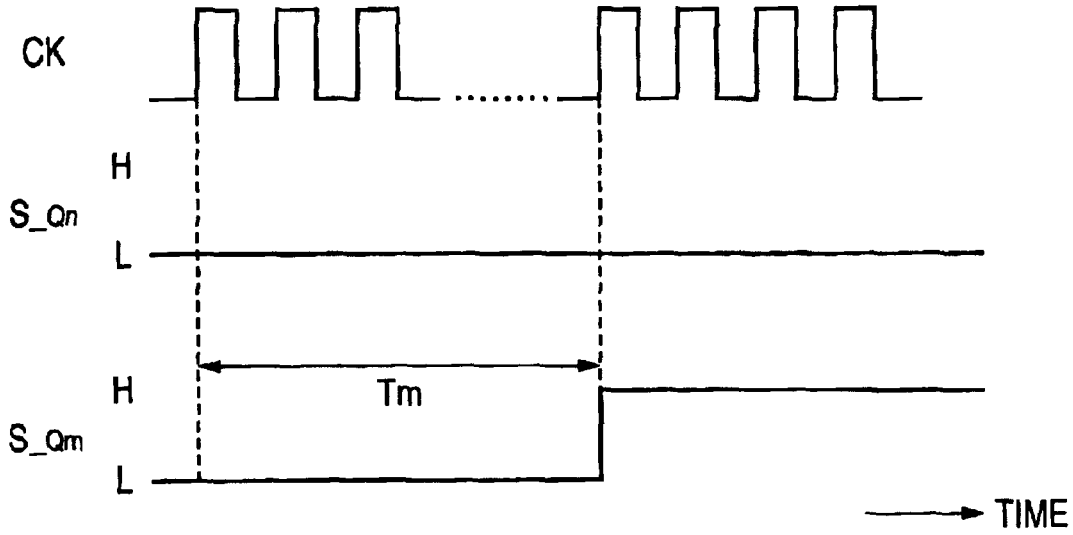
FIG. 9 is a timing chart showing operation of the FIG. 8 circuit.

FIG. 9 shows operation of the circuit arrangement when the output signal "S_Qn" is in the L level. "S_Qm" indicates an output signal of the counter 24, and "Tm" indicates a set time "Tm" of the counter.

In this case, the counter 24 is not reset, and counts the clock signal CK, and after the set time "Tm" (delay time as set) elapses, the output signal "S_Qm" goes high (H) in logical level, and subsequently, its logical state continues.

The logical sum of the output signals "S_Qn" and "S_Qm" becomes a light-on instruction signal for the low-beam discharge lamp 6L. When that signal goes high (H), that lamp lights on. For example, when the signal "Sh" goes high (H) and a light-on instruction is output to the high-beam discharge lamp 6*h*, both discharge lamps are lit on with a predetermined delay time defined by the counter 15, 24. When he signal "Sh" is in the L level, only the low-beam discharge lamp 6L is lit on after a short time delay by the counter 15.

When the high-beam discharge lamp and the low-beam discharge lamp are simultaneously lit on, a delay time ranging from the lighting on of the high-beam discharge lamp to the lighting on of the low-beam discharge lamp is set to preferably be (e.g., 0.5 second or longer) loner than a time of a light-on instruction given by the operation for a short time flashing operation (passing operation). This is done for reducing the number of lighting times by prohibiting the lighting-on of the low-beam discharge lamp during the flashing operation.

In the case using the circuits of FIGS. 4 and 8, in a case that it is recognized that the current status is to simultaneously light on the discharge lamps 6*h* and 6L (the output signal "S_Qn" is in the L level as shown in FIGS. 5 and 6), and both the discharge lamps are lighting, when the high beam irradiation switch is operated and the signal "Sh" goes high (H) in logical level, the high-beam discharge lamp 6*h* is lit off by that signal as a matter of course. For the low-beam discharge lamp 6L, the output signal "S_Qn" of the counter 15 goes high (H), and its lighting state is maintained. In a case that it is recognized that the current status is to simultaneously light on both the discharge lamps, and the output signal "S_Qn" of the counter 15 is in the L level, when the signal "Sh" goes low (L) in logical level by operating the switch before the low-beam discharge lamp 6L is lit on, the high-beam discharge lamp 6*h* is lit off, as a matter of course, and the low-beam discharge lamp 6L lights on after a time delay by the counter 24. Accordingly, when the signal "Sh" repeatedly changes its logical level between the H and L levels, if the low-beam discharge lamp 6L responsively repeats its on and off states freely, the life deterioration of the lamp is remarkable. To avoid this, the delay time of that discharge lamp is set to preferably be longer than a non-time in the operation for the flashing instruction (in the instance, the passing operation is performed in response to an instruction by the low beam irradiation switch, and hence the on-time corresponds to the H level duration of the signal "Sh"), whereby the response to the light-on instruction signal "SO" of the low-beam discharge lamp 6L is made slow.

To light on the high-beam discharge lamp 6*h* in a state that the low-beam discharge lamp 6L is lighting, it is preferable to keep its lighting state, without lighting off the low-beam discharge lamp 6L, in order to reduce the number of lighting times. In a case that it is recognized that the current status is not to simultaneously light on both the discharge lamps 6L and 6*h*, the output signal "S_Qn" of the counter 15 remains latched and retains its H level after the delay time period "Tn". Accordingly, the light-on instruction signal "SO" of the low-beam discharge lamp 6L remains H level. In a sequence where when the high-beam discharge lamp is lit on in a state that the low-beam discharge lamp is lighting, the low-beam discharge lamp is lit off, it is impossible to reduce the number of lighting times of the low-beam discharge lamp. Therefore, for the low-beam discharge lamp having been lit on, it is better to maintain its lighting state as in this instance.

When the lighting instruction is output to the discharge lamps 6*h* and 6L, and it is recognized that both the discharge lamps are simultaneously turned on, both discharge lamps light on. There is no necessity of prescribing the brightness of the discharge lamp as rated. Accordingly, the service life of the discharge lamp may be increased in a manner that the inputting electric power to the discharge lamp is reduced allowing for the use time and the use frequency of the low-beam discharge lamp 6L. Thus, it is preferable to control the electric power input to the discharge lamp when the low-beam discharge lamp is lit on together with the high-beam discharge lamp such that it is lower than that input to the discharge lamp when only the low-beam discharge lamp is lit on.

A circuit arrangement of the control circuit, and a power control method of the discharge lamp will briefly be described with reference to FIG. 10, while known ones may be used.

Figure 10:
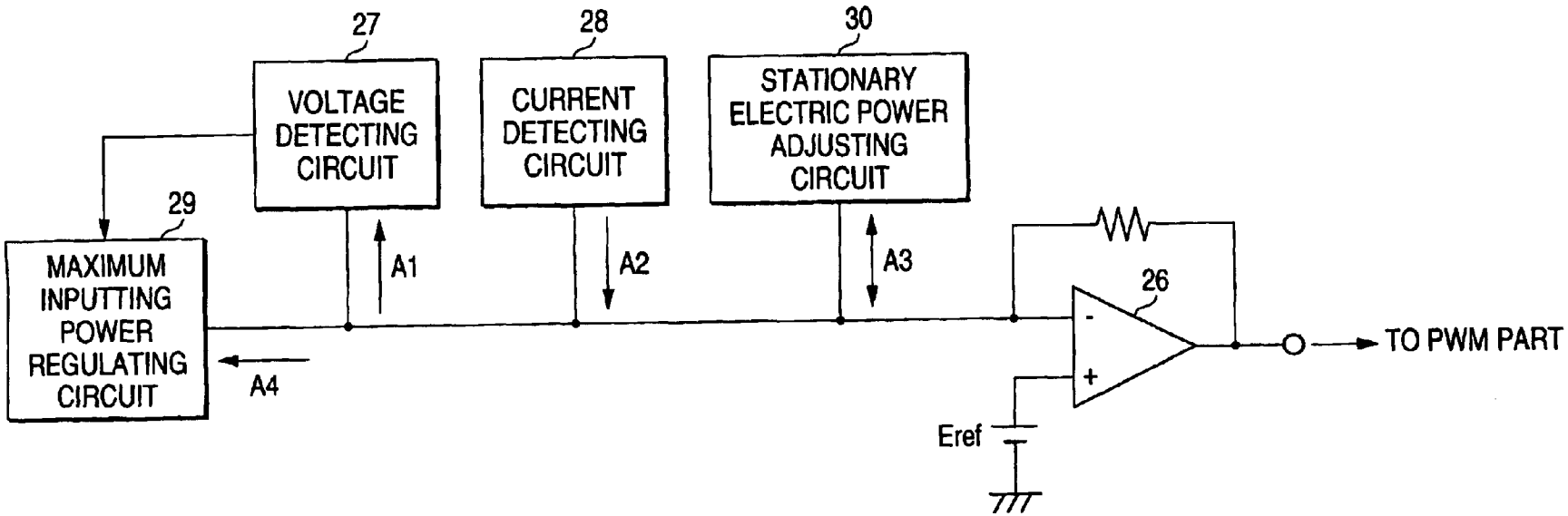
FIG. 10 is a circuit diagram showing a key portion of a control circuit.

FIG. 10 shows a major portion of a control circuit of the PWM (pulse width modulation) type.

A predetermined reference voltage Eref (indicated by a symbol indicative of a constant voltage source in the figure) is applied to a positive input terminal of an error amplifier 26. The following circuits are connected to a negative input terminal of the error amplifier.

- voltage detecting circuit (27) for detecting a voltage applied to the discharge lamp
- current detecting circuit (28) for detecting a current flowing into the discharge lamp
- maximum inputting power regulating circuit (29)
- stationary electric power adjusting circuit (30)

Of those circuits, the voltage detecting circuit 27 and the current detecting circuit 28 detect the voltage and current to the discharge lamp in response to a signal from the detector part 8.

The maximum inputting power regulating circuit 29 defines a maximum value (or an upper tolerable value) of electric power in a transient region when the discharge lamp is lit on in a state that the discharge lamp is cold. The stationary electric power adjusting circuit 30 is required for adjusting an electric power value in a constant power control in a stationary region.

Control circuit is arranged such that as the output voltage of the error amplifier 26 is larger, the electric power fed to the discharge lamp is larger. The error amplifier adjusts an output voltage of the DC/DC converter circuit 3 so that the voltage at the negative input terminal of the amplifier is equal to that reference voltage "Eref". An output voltage of the error amplifier 26 is converted into a control signal to the semiconductor switching elements SW in the DC/DC converter circuit 3 through a PWM control part (not shown), a drive circuit and others. PWM control part is a circuit which is constructed with a general PWM control IC or the like, and generates a pulse signal whose duty cycle varies in accordance with the result of comparing the input voltage and a saw-tooth wave signal.

In the figure, arrows designated by A1 to A4 indicate contributions of control current to the current input to the error amplifier 26. Directions of the arrows define the directions of the control currents of those circuits. In the case of the voltage detecting circuit 27 (see the arrow A1) and the maximum inputting power regulating circuit 29 (see the arrow A4), the directions of the control currents of the circuits are oriented away from the error amplifier 26. Accordingly, as the value of the current having such a direction increases, the electric power supplied to the discharge lamp increases. In the case of the current detecting circuit 28 (see the arrow A2), the direction of the control current is oriented toward the error amplifier 26. As the current of such a direction increases in value, the electric power supplied to the discharge lamp decreases. In the case of the stationary electric power adjusting circuit 30, a bar A3 with arrows oppositely directed is used on the control current. This arrow bar indicates that the control current can be adjusted in both directions. When the control current is adjusted in the direction away from the error amplifier 26, the electric power increases in the stationary region. Conversely, when it is adjusted in the direction toward the error amplifier, the electric power decreases in a stationary region.

In the transient region, the electric power supplied to the discharge lamp is regulated in accordance with a lighting state of the discharge lamp by the contribution of the control current by the voltage detecting circuit 27, current detecting circuit 28 and maximum inputting power regulating circuit 29. For example, when the voltage applied to the discharge lamp is low, large electric power is input to the discharge lamp. Its maximum value is determined while referring to the detect voltage, as seen from an arrow directed from the voltage detecting circuit 27 to the maximum inputting power regulating circuit 29. The control circuit performs such a control that when the current flowing into the discharge lamp is large, the electric power input to the discharge lamp decreases.

As well known, the constant electric power control to the discharge lamp in the stationary region is carried out such that the relation "V×I=W or its linear approximate expression holds (V: tube voltage, I: tube current, and W: constant electric power value). To further increase the approximation, what a designer has to do is to make complicated, the circuit arrangements of the voltage detecting circuit and the current detecting circuit so as to approximate a constant electric power curve by using a number of polygonal lines. In this case, however, demerits by an increased number of parts must be taken into consideration.

It may be considered that in the stationary region, the control current by the maximum inputting power regulating circuit 29 is not present. Accordingly, the control is carried out in accordance with the control current by the voltage detecting circuit 27, current detecting circuit 28 and stationary electric power adjusting circuit 30. In this state, the input voltage and the reference voltage are balanced at the error amplifier 26, but when the balance is lost, for example, the input voltage is lower than the reference voltage, the output voltage of the amplifier increases and the supplied voltage increases. Conversely, when the input voltage is higher than the latter, the output voltage of the amplifier decreases and the supplied voltage decrease.

When the circuit under discussion is applied to the low-beam discharge lamp 6L, and it and the high-beam discharge lamp 6*h* are simultaneously lit on, the electric power input to the low-beam discharge lamp 6L is adjusted to be smaller than the rated electric power value by the stationary electric power adjusting circuit 30, viz., the control current (source current to the negative input terminal of the error amplifier 26) is varied in the direction toward the error amplifier 26

Figure 11:
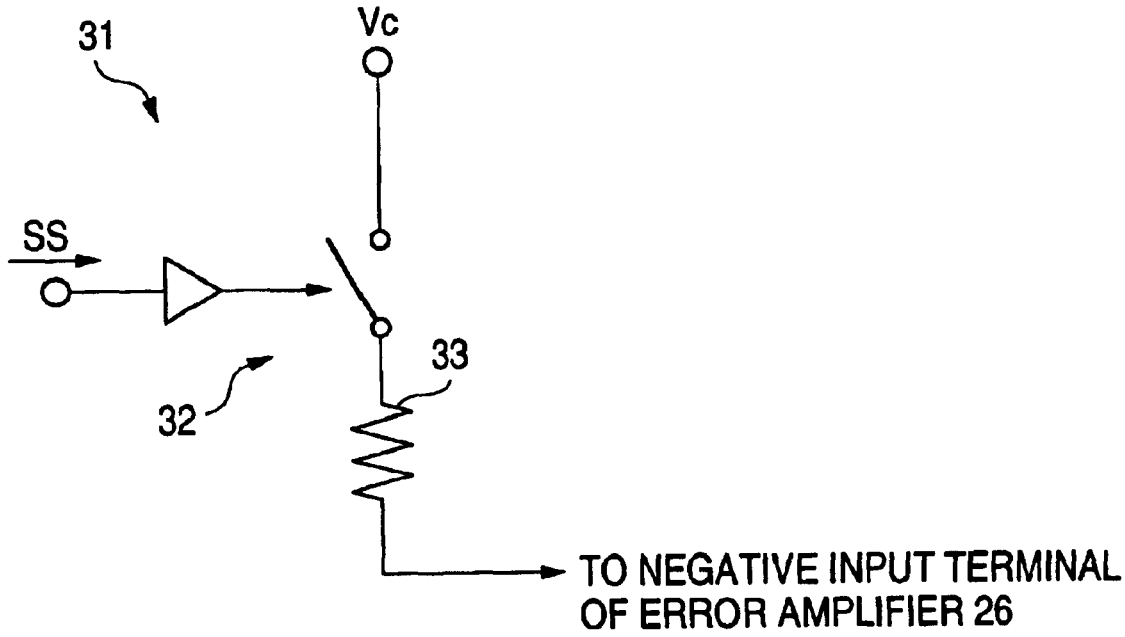
FIG. 11 is a circuit diagram exemplarily showing an electric power inputting control.

In an exemplar circuit arrangement 31 shown in FIG. 11, it is assumed that a signal "SS" is formed by ANDing a logical NOT signal of the output signal "S_Qn" and a lighting detect signal (which is in a H level in a lighting state) of the high-beam discharge lamp 6*h*. A predetermined voltage Vc is applied to the negative input terminal of the error amplifier 26, through an analog switch 32 (may be constructed with an field effect transistor, for example) which operates when receiving the signal SS, and a resistor 33 connected in series to the analog switch. When the signal SS is in the H level, the analog switch 32 is turned on. A source current which flows at this time is fed to the negative input terminal of the error amplifier 26. As this current is larger, the electric power supplied to the low-beam discharge lamp becomes smaller.

Various other electric power control modes are present. An example of such is that when the high-beam discharge lamp 6*h* and the low-beam discharge lamp 6L are substantially simultaneously lit on, the total sum of the electric power supplied to both the discharge lamps is smaller than the total sum of the rated electric power values of the discharge lamps.

The rule (2) stated above is such that in a case that it is recognized that the current status is to simultaneously light on both the discharge lamps, only the high-beam discharge lamp 6*h* is lit on, while he low-beam discharge lamp 6L is not lit on. This can satisfactorily be achieved by using the FIG. 4 circuit arrangement. The output signal "S_Qn" of the counter 15 may directly be used as the light-on instruction signal. Therefore, there is no need of using the FIG. 8 circuit.

Accordingly, as shown in FIGS. 5 and 6, in a case that it is recognized that the current status is to simultaneously light on both the discharge lamps, the output signal "S_Qn" is in the L level, and the low-beam discharge lamp 6L is lit off. In a case that it is recognized that the current status is not to simultaneously light on both the discharge lamps, as shown in FIG. 7, the low-beam discharge lamp 6L lights on at a time point when the output signal "S_Qn" goes high (H).

Such a control that when the low-beam discharge lamp 6L is already lit on, the high-beam discharge lamp 6*h* is prohibited from being lit on, is possible, as a matter of course. For example, when the lighting state of the low-beam discharge lamp 6L is detected based on the current flowing through the low-beam discharge lamp, and it is judged that that discharge lamp is lighting, a circuit for masking the light-on instruction signal to the high-beam discharge lamp 6*h* is used and operated.

In a case where the judging part 9 for judging whether it is daytime or nighttime is sued as shown in FIG. 1, when the judging part judges that it is the daytime, the control is carried out such that when one of the discharge lamps is lit on, the other discharge lamp is lit off. That is, if the rule (2) is applied to only the daytime, unnecessary lighting of the discharge lamps is eliminated. In a situation that the judging part 9 judges that it is the daytime, and the light-on instruction for lighting on both the discharge lamps 6*h* and 6L is given, the following control is allowed that only the high-beam discharge lamp 6*h* is lit on, but the low-beam discharge lamp 6L is not lit on in the daytime. Accordingly, the lighting time and the replacement frequency of the discharge lamp are reduced.

The following signals may be used for the basis information for the judgment by the judging part 9.

I) Operation signal

II) signal containing clock information

III) signal for automatic lighting-off

An example of the operation signal I) above is an operation signal to give an instruction of lighting on a lighting device other than the head lamp, such as a clearance lamp (or small lamp). The clearance lamp, for example, is to be used in dim light when the surrounding illuminance decreases or in the nighttime. It contains a light source, which is different from that of the high and low-beam discharge lamps. The judging part 9 can judges if it is the daytime or the nighttime on the basis of the operation signal (light-on instruction signal) of such a lamp. In an alteration, a switch is provided, and the driver himself or herself visually judges the environmental illuminance, and operates the switch. Judgement as to if it is the daytime or the nighttime is made on the basis of the operation signal of the switch.

The clock information contained signal II) may be used for acquiring the present time, the present position information (latitude) by the navigation system, sunrise and sunset time information by vehicle-to-vehicle communication, and weather information, and others. After all, the judging part estimates the daytime or the nighttime on the basis of the present time, date, surrounding conditions of the vehicle.

The automatic lighting-off signal III) may be a signal output from an automatic lighting unit for the vehicular lighting device. In this case, a brightness of the surroundings of the vehicle is detected by use of an illuminance sensor or an image pickup device (e.g., CCD camera), and the detection result (e.g., illuminance) is compared with a predetermined value to thereby judge if it is the daytime or the nighttime.

The signals I) to III) may be used in combination or individually. In the latter case, the priority order when those are used must be taken into consideration. In particular when the signal I) is contained, high priority must be given to the driver's will.

In FIG. 1, where the judging part 9 judges that it is the daytime and the judgement result is sent to the control circuit 7 by a signal Sdn, to use the clock information contained signal II), the signal s "Sh" and Sdn (which exhibits the H level when the judgement result is the daytime) are ANDed in the FIG. 4 circuit, for example, and the resultant is applied to one of the input terminals of the AND gate 20.

In a situation where the judging part 9 judges that it is the daytime, when a light-on instruction signal is given to the high-beam discharge lamp, for example, it is sufficient to light on that lamp. A lighting sequence is optional when the judging part 9 judges that it is the nighttime. For example, when a light-on instruction signal to the high-beam discharge lamp is given, the high-beam discharge lamp or the high-beam discharge lamp and the low-beam discharge lamp are lit on.

As seen from the foregoing description, the first and fifth characteristic features of the invention reduce the lighting time and the number of lighting times, thereby preventing the reduction of the service life of the discharge lamp, and reducing the replacement frequency of the discharge lamps.

A second characteristic feature of the invention prohibits the low-beam discharge lamp from flashing at the time of short time flashing operation, to thereby reduce the number of lighting times.

A third characteristic feature reduces the electric power input to the low-beam discharge lamp and hence increases the service life of the lamp.

A fourth characteristic feature reduces the number of lighting times of the SL input time point.

In a fourth characteristic feature of the invention, when it is judge to be the daytime, only one discharge lamp is lit on, thereby preventing the reduction of the service life of the discharge lamp.

What is claimed is:

1. A vehicle lighting device comprising:

a high-beam discharge lamp and a low-beam discharge lamp;

a DC/DC converter circuit for converting an input voltage output from a DC power source into a desired DC voltage;

a DC/AC converter circuit for converting an output voltage of said DC/DC converter circuit into an AC voltage;

starter circuits for applying start pulse signals to said discharge lamps; and a control circuit for controlling the lighting of the discharge lamps by detecting voltage or current of each said discharge lamp;

wherein when an instruction to light on said high-beam discharge lamp and said low-beam discharge lamp is given, and said high-beam discharge lamp is lit on in a state that said low-beam discharge lamp is lit off, said low-beam discharge lamp is lit on with a certain time delay.

2. A vehicle lighting device according to claim 1, wherein a delay time ranging from the lighting on of said high-beam discharge lamp to the lighting on of said low-beam discharge lamp is set to be longer than a time of a light-on instruction given by the operation for a short time flashing operation.

3. A vehicle lighting device according to claim 1, wherein said control circuit controls electric power input to said discharge lamps such that electric power input to said high-beam discharge lamp and said low-beam discharge lamp when said discharge lamps are both lit on is smaller than electric power input to said low-beam discharge lamp when only said low-beam discharge lamp is lit on.

4. A vehicle lighting device according to claim 1, wherein when said high-beam discharge lamp is lit on in a state that said low-beam discharge lamp is lighting, said low-beam discharge lamp is kept in a lighting-on state.

5. A vehicle lighting device according to claim 2, wherein said control circuit controls electric power input to said discharge lamps such that electric power input to said high-beam discharge lamp and said low-beam discharge lamp when said discharge lamps are both lit on is smaller than electric power input to said low-beam discharge lamp when only said low-beam discharge lamp is lit on.

6. A vehicle lighting device comprising:

a high-beam discharge lamp and a low-beam discharge lamp;

a DC/DC converter circuit for converting an input voltage output from a DC power source into a desired DC voltage;

a DC/AC converter circuit for converting an output voltage of said DC/DC converter circuit into an AC voltage;

starter circuits for applying start pulse signals to said discharge lamps; and a control circuit for controlling the lighting of the discharge lamps by detecting voltage or current of each said discharge lamp, wherein when one of said high-beam discharge lamp and said low-beam discharge lamp is lighting, the other discharge lamp is lit off.

7. A vehicle lighting device according to claim 6, further comprising a judging part for judging if it is the daytime or nighttime, and only when said judging part judges that it is the daytime and one of said discharge lamps is lighting, the other discharge lamp is lit off.

* * * * *